United States Patent [19]

Smith et al.

[11] Patent Number: 4,904,207

[45] Date of Patent: Feb. 27, 1990

[54] ISOLATED SOLDER JACK

[75] Inventors: Donald L. Smith, Middletown; Ronald C. Laudig, Mechanicsburg; Tracey L. Smith, Harrisburg, all of Pa.

[73] Assignee: AMP Incorporated, Harrisburg, Pa.

[21] Appl. No.: 373,419

[22] Filed: Jun. 30, 1989

[51] Int. Cl.[4] ..... H01R 17/18

[52] U.S. Cl. ..... 439/585

[58] Field of Search ..... 439/578–585

[56] References Cited

U.S. PATENT DOCUMENTS

| | | | |
|---|---|---|---|
| 3,356,800 | 12/1967 | Bailey et al. | 439/578 |
| 3,453,377 | 7/1969 | Gillespie | 174/75 |
| 3,893,743 | 7/1975 | Wallo | 439/578 |
| 4,795,352 | 1/1989 | Capp et al. | 439/581 |

*Primary Examiner*—Joseph H. McGlynn

[57] ABSTRACT

An electrical connector 1 comprising, a ring 22 and a tab 23 are surrounded by insulation material formed with an annulus 27 and a tube 29, the ring 22 is assembled over a rear shell portion 3 of a shell with the tab 23 and the tube 29 received along a tunnel 20 in a rear shell portion 3, and a front shell portion 4 of the shell is assembled by movement to the rear concentrically between the annulus 27 and the rear shell portion 3.

5 Claims, 4 Drawing Sheets

ISOLATED SOLDER JACK

FIELD OF THE INVENTION

The specification describes a coaxial electrical connector for solder assembly.

BACKGROUND OF THE INVENTION

U.S. Pat. No. 3,453,377 discloses a coaxial electrical connector comprising, a conductive central contact concentrically within a dielectric body, a conductive shell concentrically encircling the dielectric body, and a conductive ring having a conductive tab projecting outwardly from the shell, and a means for attaching an auxiliary conductor to the ring. The auxiliary conductor is attached by crimping the ring radially to clamp the auxiliary conductor between the ring and the shell. There is a need for attaching the auxiliary conductor directly to the tab by a solder connection.

In one form of connector, an insulation covered wire, instead of a tab, is joined to the ring with a solder joint. The insulation is stripped from the wire, thereby to expose a portion of the wire for joining to the ring. Assembly of the solder joint in the connector is a time consuming task, adding to the cost of the connector. Assembly of the component parts of the connector must be accomplished without disturbing the solder joint, and to insure that the wire will project outwardly from the connector, further adding to the cost of the connector. Again, the insulation is stripped from the wire, which now projects outwardly from the connector, thereby to expose a portion of the wire for connection to the auxiliary conductor with solder. Summary Of The Invention An objective of the invention is to eliminate an insulation covered wire to provide for connection of an auxiliary wire to a ring of a connector.

A feature of the invention is a unitary ring and projecting tab within an injection molded insulation. Advantageously, the insulation facilitates assembly of the ring in a connector.

Another objective of the invention is to eliminate awkward procedures to assemble component parts of a connector to avoid disturbing a solder joint of an insulation covered wire. A feature of the invention resides in component parts designed for assembly one to the other by movement in the same direction. In U.S. Pat. No. 4,795,352, a coaxial connector has component parts that stack together by movement in the same direction.

These and other advantages, features and objectives of the invention are disclosed by way of example from the following detailed description and accompanying drawings.

DESCRIPTION OF THE DRAWINGS

With reference to FIGS. 1 and 4, an electrical connector 1 includes an outer, conductive shell 2 having a rear shell portion 3 and a front shell portion 4, a ring assembly 5, a dielectric body 6, a conductive central contact 7 and a press fit ring 8. A conductive solder lug 9 is shown in FIG. 12.

With reference to FIGS. 9, 10 and 11, the rear shell portion 3 is conductive, machined from metal with a stepped external diameter, and includes a reduced cylindrical front end portion 10 with circumferential, external knurling 11, and an enlarged cylindrical rear end portion 12 with an axially extending flat 13, and an external diametrically projecting flange 14 spaced from a front 15 and a rear 16 of the rear shell portion 3, and external threads 17 to the rear of the flange 14. A cylindrical cavity 18 extends concentrically of the rear shell portion 3. An interior wall 19 projects radially inward of the cavity 18 and is flush with the rear 16. An axial tunnel 20 extends through the rear end portion 12 parallel to the cavity 18. An optional recess 21 in the rear 16 is spaced along an arc from the tunnel 20.

In FIGS. 5, 6, 7 and 8, the ring assembly 5 includes a unitary ring 22 and solder receiving tab 23 stamped and formed from a strip of metal having a thickness plane. The tab 23 is bent to provide a curved bight 24 connected to the ring 22, and to project outwardly from the bight 24 and outwardly of the thickness plane of the ring 22. The ring 22 is stiffened by a relatively thick, conductive ring known as a code ring 25 that has a cupped recess 26 registered against the ring 22. An insulative material, polypropylene, for example, is insert molded in the form of an annulus 27 that surrounds and imbeds the ring 22, leaving a radial, front surface 28 of the code ring 25 exposed for conductively engaging a panel, not shown. A tube 29 of the unitary insulative material encircles a length of the tab 23 except for an exposed, solder receiving tip 30 of the tab 23 that has an aperture 31 to receive and hold an auxiliary wire, not shown, during solder joining to the tab 23. The annulus 27 has a cylindrical rear recess 32, FIG. 7, intersecting a flat wall 33. The annulus 27 has a front projecting circular lip 34 overlapping the front surface 28 of the code ring 25.

With reference to FIGS. 3 and 4, the ring assembly 5 is assembled by movement in a direction to the rear and onto the rear shell portion 3, until the annulus 27 is opposite and against the flange 14. The front 15 is received in the rear recess 32. The flat 13, on the front 15 and to the front of the flange 14, is received along the flat wall 33 to prevent relative rotation of the ring assembly 5 and the rear shell portion 3. The insulation covered tab 23 is received along the tunnel 20 and projects outwardly and axially from the rear 16.

Figure 3:
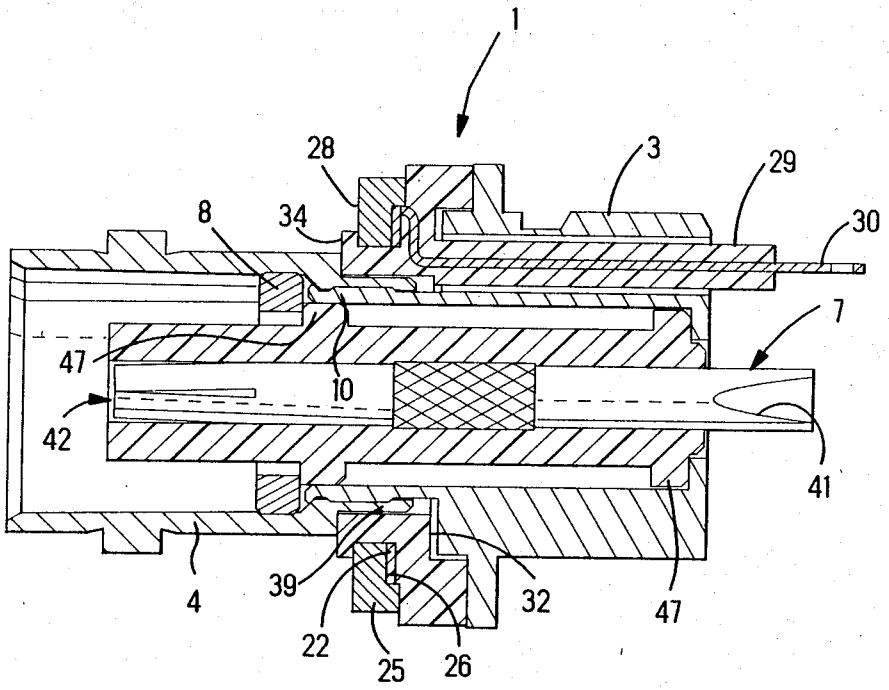
FIG. 3 is a longitudinal section view of the connector shown in FIG. 1.
Figure 2:
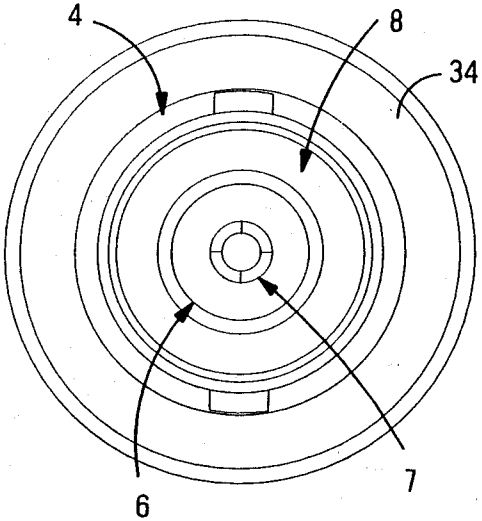
FIG. 2 is an end elevation view of the connector shown in FIG. 1.
Figure 4:
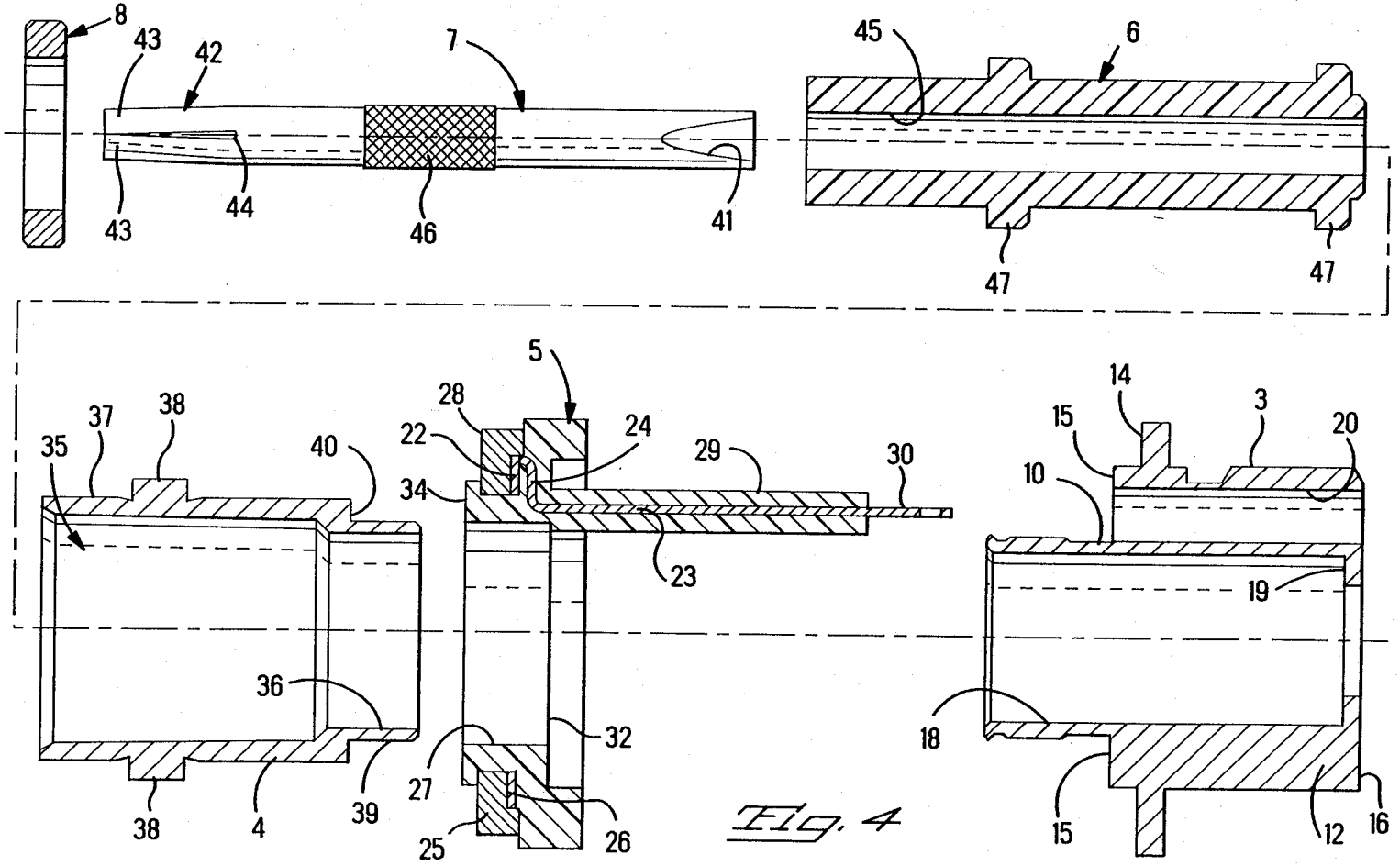
FIG. 4 is a perspective view with parts exploded of a portion of the connector shown in FIG. 2.
Figure 5:
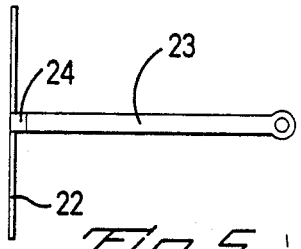
FIG. 5 is a front elevation view of a ring and tab.
Figure 6:
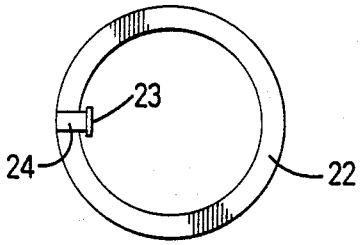
FIG. 6 is a side elevation view of the ring and the tab shown in FIG. 5.
Figure 7:
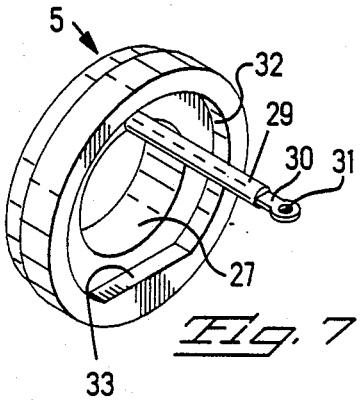
FIGS. 7 and 8 are perspective views of the ring and tab assembled with a conductive code ring and injection molded insulation.
Figure 8:
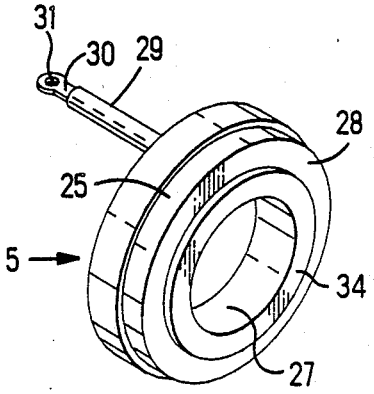
Figure 9:
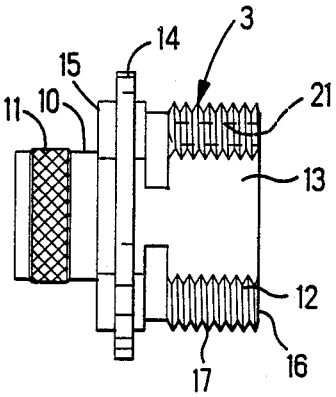
FIG. 9 is an elevation view of a conductive shell.
Figure 11:
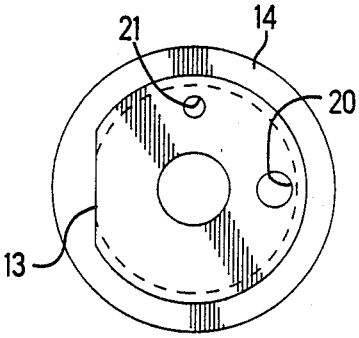
FIGS. 10 and 11 are end elevation views of the shell shown in FIG. 9.
Figure 10:
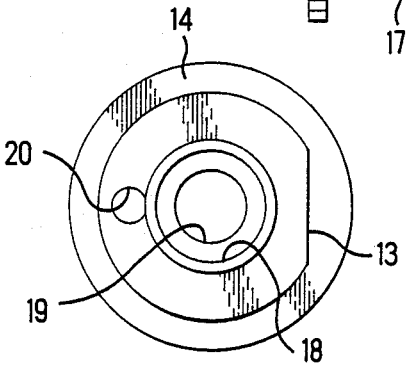

The front shell portion 4, FIGS. 3 and 4, has a stepped diameter passage 35 with an interior wall 36, and a stepped cylindrical exterior. A front portion 37 has radially projecting bayonet prongs 38 for making a bayonet coupling with another connector, not shown. A rear portion 39 has a reduced diameter and projects rearward from a rear facing, external radial shoulder 40. The front shell portion 4 is assembled by movement to the rear, with the rear portion 39 being inserted within the annulus 27 until the shoulder 40 registers opposite and against the lip 34 of the annulus 27. The interior wall 36 is press fit concentrically over the front end portion 10 of the rear shell portion 3, and is frictionally retained by the knurling 11.

Figure 1:
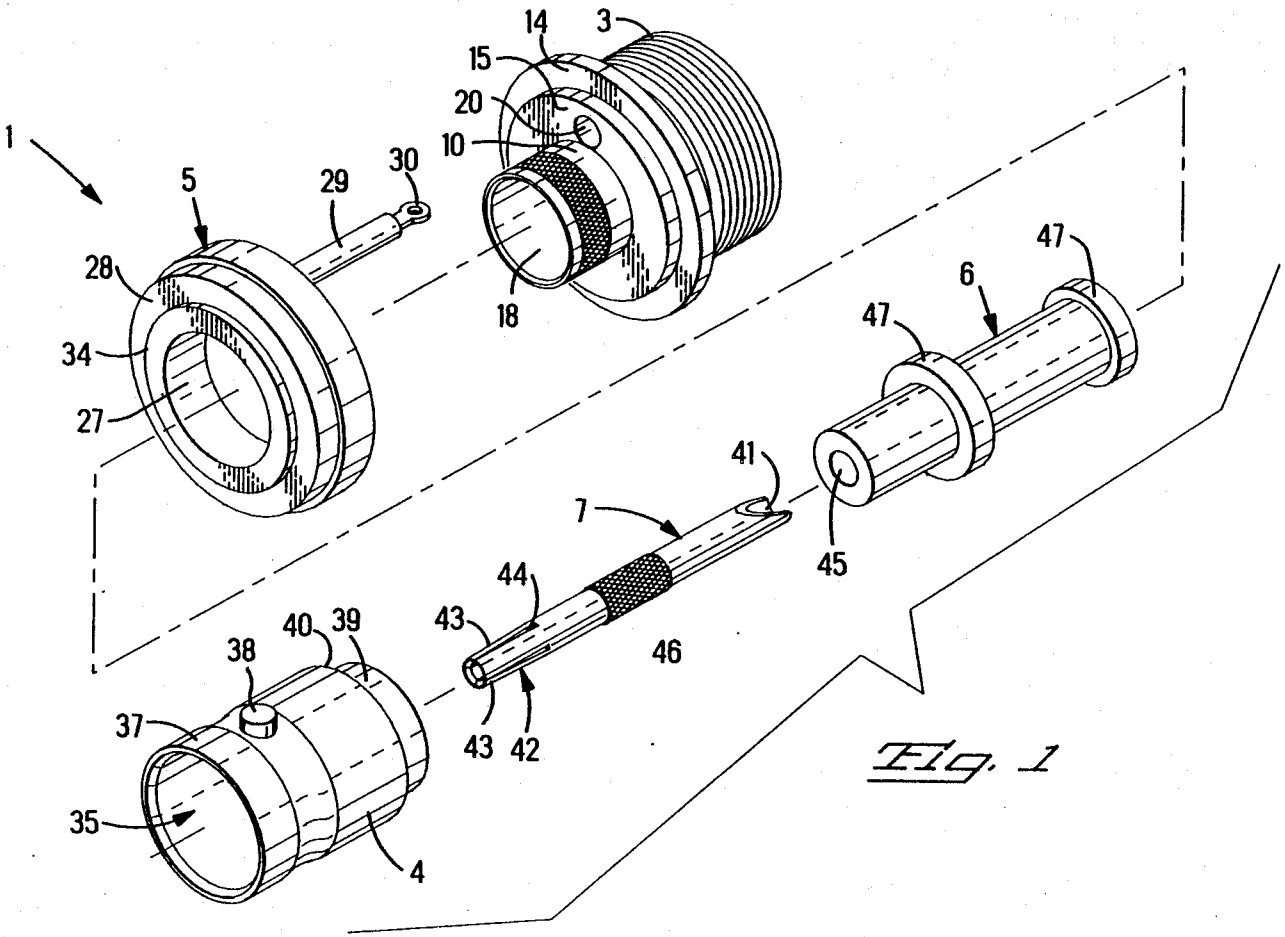
FIG. 1 is a perspective view of an electrical connector.

With reference to FIGS. 1 ,3 and 4, the central contact 7 is of unitary, elongated, solid cylindrical form, with a solder receiving recess 41 in a rear end, and an electrical receptacle portion 42 in a front end defined by circumferentially spaced apart fingers 43, with adjacent fingers separated by narrow slots 44. The contact 7 is assembled to the dielectric body 6 by movement of the contact 7 to the rear and into an axial bore 45 of the dielectric body 6. The dielectric body 6 is of unitary, cylindrical, elongated form, and concentrically encircles the central contact 7. A central, knurled portion 46 is secured in the axial bore 45. Axially spaced external, radially projecting collars 47 are on the dielectric body 6 and have a sliding fit with the cavity 18.

Figure 12:
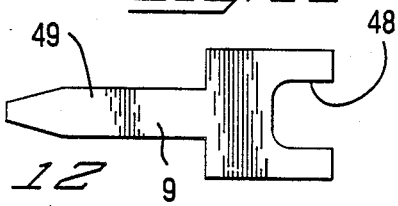
FIG. 12 is a top plan view of a solder tab.

The dielectric body 6 is assembled by movement to the rear into the cavity 18, until a rear one of the collars 47 registers against the interior wall !9. The other, front one of the collars 47 is within the cavity 18 and protrudes to the front end portion 10. The press fit ring 8 having a press fit against the wall 36 of the passage 35 is inserted along the passage 35 by movement to the rear until a rear of the ring 8 is opposite and engages the protruding front one of the collars 47. The solder receiving recess 41 projects outwardly of the rear 16 of the rear shell portion 3. To complete the assembly, the solder lug 9, FIG. 12, has a yoke 48 and an electrical stem 49. The stem 49 is received in the recess 21 in the rear 16, and is soldered in place. The yoke 48 projects outwardly of the rear 16 to provide an electrical connection lug 9 for the rear shell portion 3.

Each of the discussed advantages, features and objectives of the disclosed invention exists independently and contributes to the use and importance of the invention.

We claim:

1. An electrical connector comprising, a conductive central contact concentrically within a dielectric body, a conductive shell concentrically encircling the dielectric body, and a conductive ring having a conductive tab projecting outwardly from the shell, wherein the improvement comprises;

the dielectric body is assembled in the shell by movement to the rear, the ring and the tab are surrounded by insulation material formed with an annulus and a tube, the ring is assembled over a rear shell portion of the shell with the tab and the tube received along a tunnel in the rear shell portion, and a front shell portion of the shell is assembled by movement to the rear concentrically between the annulus and the rear shell portion.

2. An electrical connector as recited in claim 1, wherein the improvement comprises;

a press ring inserted by movement to the rear along an interior of the front shell portion and opposing the dielectric body.

3. An electrical connector as recited in claim 1, wherein the improvement comprises;

the dielectric body includes an external collar engaged against an internal wall of the rear shell portion.

4. An electrical connector as recited in claim 1, wherein the improvement comprises;

the dielectric body includes an external second collar protruding from the rear shell portion and engaged by a press ring in the front shell portion.

5. An electrical connector as recited in claim 1, wherein the improvement comprises;

the ring and the tab are unitary, and the tab is bent with a bight and to project from a plane of the ring, and the insulative material surrounds the bight.

* * * * *